US005320283A

United States Patent [19]

Hollstein et al.

[11] Patent Number: 5,320,283

[45] Date of Patent: Jun. 14, 1994

[54] ROBOT MOUNTED TWIN HEADED ADJUSTABLE POWDER COATING SYSTEM WITH SPRAY PATTERN DIRECTION CONTROL

[75] Inventors: Thomas E. Hollstein, Amherst; John F. Carlson, Westlake; Dean A. Koch; David Moses, both of Amherst, all of Ohio

[73] Assignee: Nordson Corporation, Westlake, Ohio

[21] Appl. No.: 10,242

[22] Filed: Jan. 28, 1993

[51] Int. Cl.[5] ..... B05B 5/025; B05B 15/08

[52] U.S. Cl. ..... 239/695; 239/587.1; 239/588

[58] Field of Search ..... 239/695, 696, 690, 694, 239/243, 587.1, 587.2, 588, 548, 704, 706–708, 697, 698; 118/313, 315; 901/43

[56] References Cited

U.S. PATENT DOCUMENTS

| | | | |
|---|---|---|---|
| Re. 33,482 | 12/1990 | Mulder et al. . | |
| 3,219,276 | 11/1965 | Norris | 239/695 |
| 3,740,612 | 6/1973 | Gauthier et al. . | |
| 3,746,254 | 7/1973 | Duncan et al. . | |
| 3,873,024 | 3/1975 | Probst et al. . | |
| 3,940,061 | 2/1976 | Gimple et al. . | |
| 4,248,379 | 2/1981 | Hollstein et al. . | |
| 4,294,411 | 10/1981 | Hastings et al. . | |
| 4,302,481 | 11/1981 | Ribnitz et al. . | |
| 4,561,592 | 12/1985 | Fender et al. | 239/587.2 |
| 4,613,082 | 9/1986 | Gimple et al. | 239/690 |
| 4,679,734 | 7/1987 | Mommsen et al. | 239/694 |
| 4,723,713 | 2/1988 | Dahlquist | 239/587.2 |
| 4,779,804 | 10/1988 | Baba et al. | 239/690 |
| 4,798,341 | 1/1989 | Gimple | 239/694 |
| 4,821,673 | 4/1989 | Kirigakubo et al. | 239/587.2 |
| 4,921,172 | 5/1990 | Belmain et al. . | |
| 5,056,720 | 10/1991 | Crum et al. | 239/698 |
| 5,071,074 | 12/1991 | Lind | 239/690 |

OTHER PUBLICATIONS

Volstatic Product Data Sheet for an HP1000 Automatic Powder Spray Gun; Volstatic, Inc., Florence, Ky. (date unknown).

Twin Air Atomizing Electrostatic Gun, TRP 402 60 SS, Sames Electrostatic, Inc., Stratford, Conn. (date unknown).

*Primary Examiner*—Karen B. Merritt

*Attorney, Agent, or Firm*—Howard M. Cohn

[57] ABSTRACT

A twin headed, electrostatic powder coating gun assembly in a lightweight, hollow housing readily mounted on a programmable robot so that the shape of the powder spray pattern can be controlled. The powder coating guns can be mounted in an adjustable housing and/or adjustably mounted in an unadjustable housing. The powder coating guns include an air purge system to clean the nozzles of coating powder.

25 Claims, 11 Drawing Sheets

ROBOT MOUNTED TWIN HEADED ADJUSTABLE POWDER COATING SYSTEM WITH SPRAY PATTERN DIRECTION CONTROL

FIELD OF THE INVENTION

This invention relates to the field of robot mounted, powder coating systems. More particularly, the invention relates to powder coating guns which are assembled in a lightweight, hollow housing that is readily adapted for mounting to a programmable, industrial robot. The hollow housing can be adjustable and/or the powder coating guns can be adjustably mounted within the hollow housing so that the direction and/or shape of the powder spray pattern can be controlled. An air purge system is also included to clean the powder coating guns of coating powder.

BACKGROUND OF THE INVENTION

Coating guns are typically mounted on programmable industrial robots for use in automated production lines. The robots are advantageous for applying an even coating of powder to irregular shaped articles. The robots can be programmed to coat articles with different configurations and to coat successive articles different from previously coated articles. For example, U.S. Pat. No. 4,798,341, discloses an improved coating gun for mounting on a programmable industrial robot. This patent is directed to the application of a liquid spray by a single coating gun.

Normally, a wrist component is attached to the end of the robot arm for mounting the coating gun. The arm moves to position the coating gun in space and the wrist component provides two or three axes of motion for aiming the coating gun relative to the end of the robot arm. However, there is a limit to the weight which can be mounted to the end of the robot arm without interfering with the operation of the robot. Also, the robot mounted guns are typically not easily removed from the robot and sometimes require excessive system downtime for repairs.

In certain powder coating applications, it is desirable to provide two coating guns within a single housing so that the desired spray pattern is formed with a desired direction and/or shape. While the provision of twin guns in a single housing is known, the guns have typically been secured within the housing in a single position. When an operator desires to change the direction or adjust the shape of the spray pattern, the housing is typically removed from the robot arm and replaced with a different housing wherein the two guns are repositioned to direct the spray in a different direction or to form a desired spray pattern shape. This procedure can be expensive because it requires stocking a number of different coating guns housings, each locating the guns in a different position. Alternatively, one set of coating guns can be removed from one housing and assembled in a different position in another housing. While there is a financial savings in reducing the number of guns carried in inventory, the disassembly and replacement is a time consuming operation which can still be expensive because of excessive system downtime.

Another problem in assembling or replacing guns within a housing is that the powder and electrical connections between the robot and the coating guns are typically provided by rigid tubes which are shaped to accommodate a specific mounting position. Therefore, if the position of the coating guns in the housing is changed, the connecting tubes may also have to replaced or bent to a different configuration to accommodate the repositioned powder guns. Both of these possibilities are expensive because they require a larger parts inventory and can be a time consuming activity which causes excessive system downtime.

An electrostatic powder coating gun periodically requires cleaning to remove powder which builds up within the gun, primarily within the nozzle of the gun. Cleaning the nozzle is also required whenever the powder color is changed. Cleaning the gun can be time consuming for the operator and result in excessive system downtime.

OBJECTS AND SUMMARY OF THE INVENTION

It is an object of the present invention to provide a robot mounted, twin headed, electrostatic powder coating gun assembly which obviates the problems and limitations of the prior art apparatus.

It is a further object of the present invention to provide a twin headed, electrostatic powder coating gun assembly incorporating a lightweight, hollow housing that is readily adapted for quick mounting to and dismounting from a programmable robot.

It is yet a further object of the present invention to provide a twin headed, electrostatic powder coating gun assembly wherein the powder coating guns are mounted in an adjustable hollow housing so that the direction of the powder spray pattern can be controlled.

It is also a further object of the present invention to provide a twin headed, electrostatic powder coating gun assembly wherein the powder coating guns are adjustably mounted with respect to each other so that the shape of the powder spray pattern can be controlled.

It is still a further object of the present invention to provide a twin headed, electrostatic powder coating gun assembly which includes an air purge system to clean the powder coating guns of coating powder.

Yet another object is to provide a twin headed, electrostatic powder coating gun housing constructed of lightweight, electrically non-conductive, plastic material.

In accordance with the invention, a powder coating gun assembly adapted for mounting to a robot includes an upright support section with upper and lower portions and a head section extending outward from the upper portion. A plurality of coating guns are mounted within the hollow housing for emitting a spray of powder coating material from a discharge end of the head section. Structural means are provided for detachably mounting the hollow housing to the robot.

Also in accordance with the invention, the hollow housing is molded from electrically non-conductive plastic and is assembled from two mating sections which form an internal chamber to house the coating guns. The structural means for detachably mounting the hollow housing to the robot includes a base end of the housing which can be removably mounted to a wrist adapter secured to the robot. The base end has a circular flange thereabout with an upward facing inclined surface and the wrist adapter has a circular flange thereabout with a downward facing inclined surface. A circular barrel clamp wedges against the upward and downward facing inclined surfaces to securely couple the base end of the hollow housing to the wrist adapter.

Further in accordance with the invention, the coating guns housed within the internal chamber of the hollow housing each include a voltage multiplier secured within the lower portion of the upright support section; a resistor/electrode assembly secured within the head section of the housing; a flexible hose which delivers powder coating material from the robot to the resistor-/electrode assembly; and a flexible electrostatic cable which connects the voltage multiplier to the resistor-/electrode assembly.

In accordance with the invention, the base end of the hollow housing has hose fitting adapters extending therethrough which connect to the flexible hoses and an electrical component extending therethrough having two flexible electrostatic cables extending therefrom which connect to the voltage multipliers. The wrist adapter which couples to the base end of the hollow housing includes hose adapters which extend therethrough and are connected by flexible hoses to a source of coating powder material. The hose adapters are sealed to the hose fitting adapters when the hollow housing is mounted to the wrist adapter. A second electrical component extending through the wrist adapter is connected to a power supply and coupled to the electrical component in the base end of the housing when the latter is coupled to the wrist adapter.

Also in accordance with the invention, the powder coating gun assembly can include an air purge system to clean each of the resistor/electrode assemblies of powder coating material when the flow of powder coating material is turned off. The air purge system includes flexible hoses within the hollow housing which deliver pressurized air to the electrode/resistor assemblies. The electrode/resistor assemblies, which incorporate the air purge feature, include a throughbore which communicates via a transverse wall with an internal chamber extending rearward through the electrode/resistor assembly. An electrode assembly extends through the internal chamber, the transverse wall, and outward from the coating gun nozzle to electrostatically charge coating powder being discharged from the nozzle. A seal positioned between the electrode assembly and the transverse wall prevents powder leakage from the throughbore to the internal chamber. The air purge system includes an air passageway through the resistor-/electrode assembly which communicates with the throughbore forward of the transverse wall to direct pressurized air therein and expel powder from the nozzle.

In accordance with the invention, the powder coating gun assembly can include means for adjusting the position of the head section of the hollow housing with respect to the upright support section whereby the direction of the spray pattern of powder emitted from the discharge end of the head section can be adjusted. The upriqht support section has an opening in its upper end which receives a curved inlet end of the head section. The head section is rotatably secured to the upright support section by a bolt so that the head section can be pivoted with respect to the support section. A plurality of positioning holes are located on opposite sides of the head section along an arc at an equal distance from the bolt. Two locking holes are aligned with each other and extend through opposite sides of the upright support section. A removable locking pin is inserted through the two locking holes and through a pair of positioning holes to position the head section so that the nozzles emit the spray pattern in the desired direction.

In accordance with the invention, the coating gun assembly can further include means for adjusting the position of the coating guns with respect to each other so as to change the spray pattern of coating powder emitted therefrom. The means for adjusting position of the coating guns includes forward and rearward positioned mounting holes on opposite sides of the electrode/resistor assemblies. Oppositely disposed upper and lower paired mounting pins which extend outward from opposite, facing inner surfaces of the head section, project into the forward positioned mounting holes so that electrode/resistors are pivotally mounted thereon. Oppositely disposed upper and lower, paired mounting slots are provided through opposite facing surfaces of the head section. The mounting slots have a radius of curvature equal to the distance to the corresponding mounting pins. Adjustment securing means, such as screws, are inserted through mounting slots and secured within rearward positioned mounting holes. The invention provides for the positioning of the coating guns with or without the positioning of the head section with respect to the upright support section.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
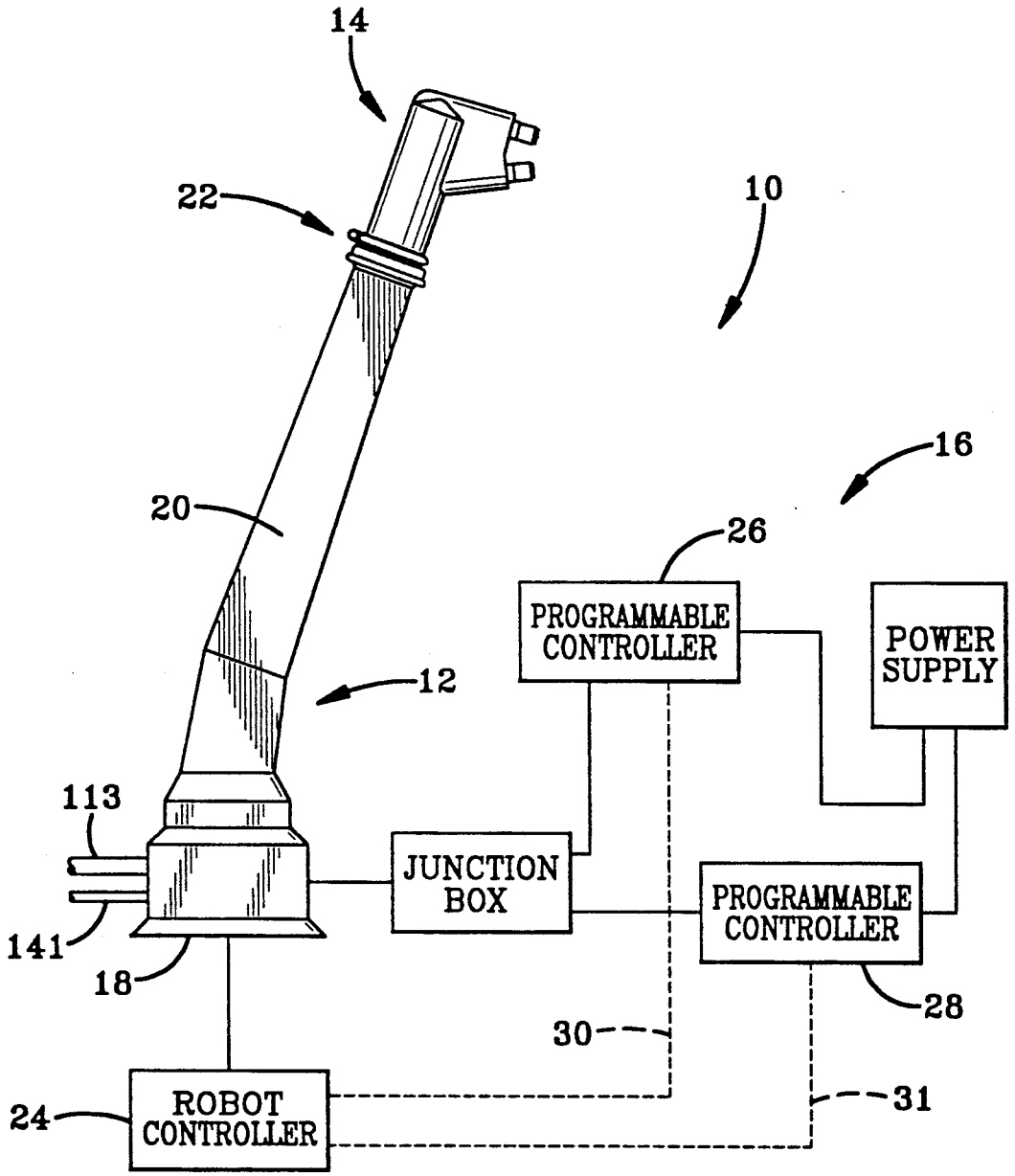
FIG. 1 is a schematic view of a coating system including a programmable robot mounting a powder coating gun assembly in accordance with the invention and a control system for operating the robot and the coating gun assembly.

FIG. 1 shows a schematic illustration of a coating system 10 which includes an industrial, programmable robot 12 mounting an electrostatic, powder coating, gun assembly 14, in accordance with the invention, and a control system 16 for operating the robot 12 and the coating gun assembly 14. The industrial, programmable robot 12 is conventional and is shown with a base 18 on which a movable arm 20 is mounted. The coating gun assembly 14 is mounted by a writ 22 to the end of movable arm 20. Typically, in a programmable robot 12, the arm 20 has three axes of movement to move and position the coating gun assembly 14 in space and the wrist provides two or three axis of motion for aiming gun assembly 14 in any desired direction.

A robot programmable controller 24 is connected to robot 12 for storing program instructions to drive the robot arm 20 through a desired path and to aim the gun assembly 14 at a workpiece as it is moved through the path. The robot 12 and the programmable controller 24 are well known in the prior art, as shown in U.S. Pat. No. 4,798,341, and do not make up a part of the present invention. Programmable controllers 26 and 28 store information for triggering the two coating guns 29 and 29A disposed in gun assembly 14 on and off as the coating gun assembly is moved across the surface of a workpiece, as discussed in more detail below. Throughout the specification, numbers followed by an "A" represent structural elements which are substantially identical to structural elements represented by the same numbers without an "A". In addition, the programmable controllers 26 and 28 can operate a purge system discussed in detail below. The robot controller 24 can communicate with programmable controllers 26 and 28 through control lines 30 and 3;, respectively, to signal the position of the arm 20 or the wrist 22, as required.

Figure 2:
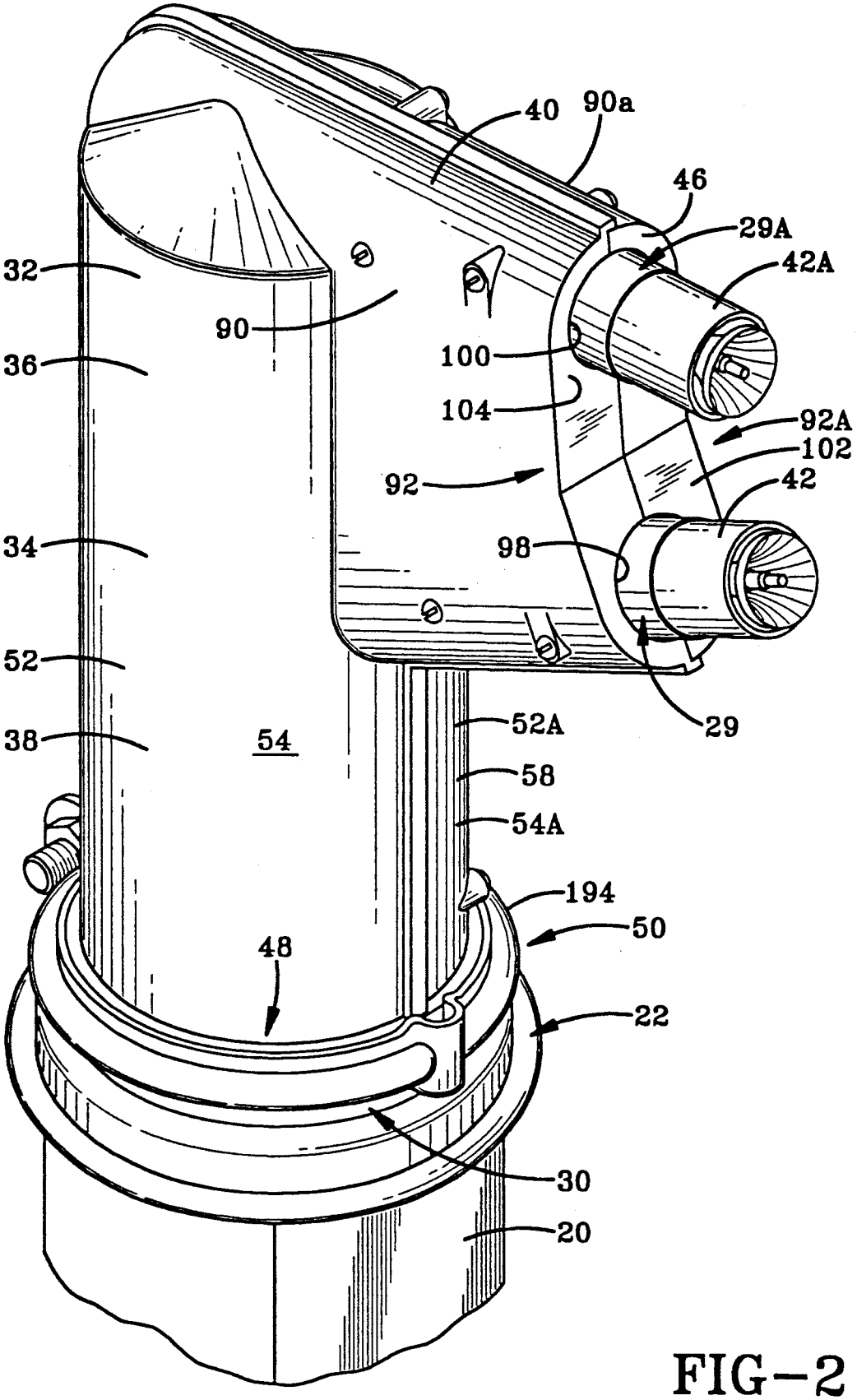
FIG. 2 is a perspective view of an assembled twin headed, electrostatic powder coating gun assembly shown prior to being secured to the programmable robot, in accordance with the invention.

Referring to FIG. 2, the twin headed, electrostatic, powder coating gun assembly 14 is shown mounted to arm 20 of programmable, industrial robot 12. Coating gun assembly 14 includes a hollow housing 32 constructed of a tubular, upright support section 34 having upper and lower portions 36 and 38, respectively. A head section 40 extends outward from one side of upper portion 36 of support section 34. Nozzles 42 and 42A of coating guns 29 and 29A, respectively, project outward from a discharge end 46 of head section 40 for emitting a spray of electrostatically charged, coating powder. The lower portion 38 of upright support section 34 has a base end 48 for mounting the gun assembly 14 to robot 12. Base end 48 is secured by detachable mounting means 50, discussed in detail below, to the end of robot arm 20.

Figure 3:
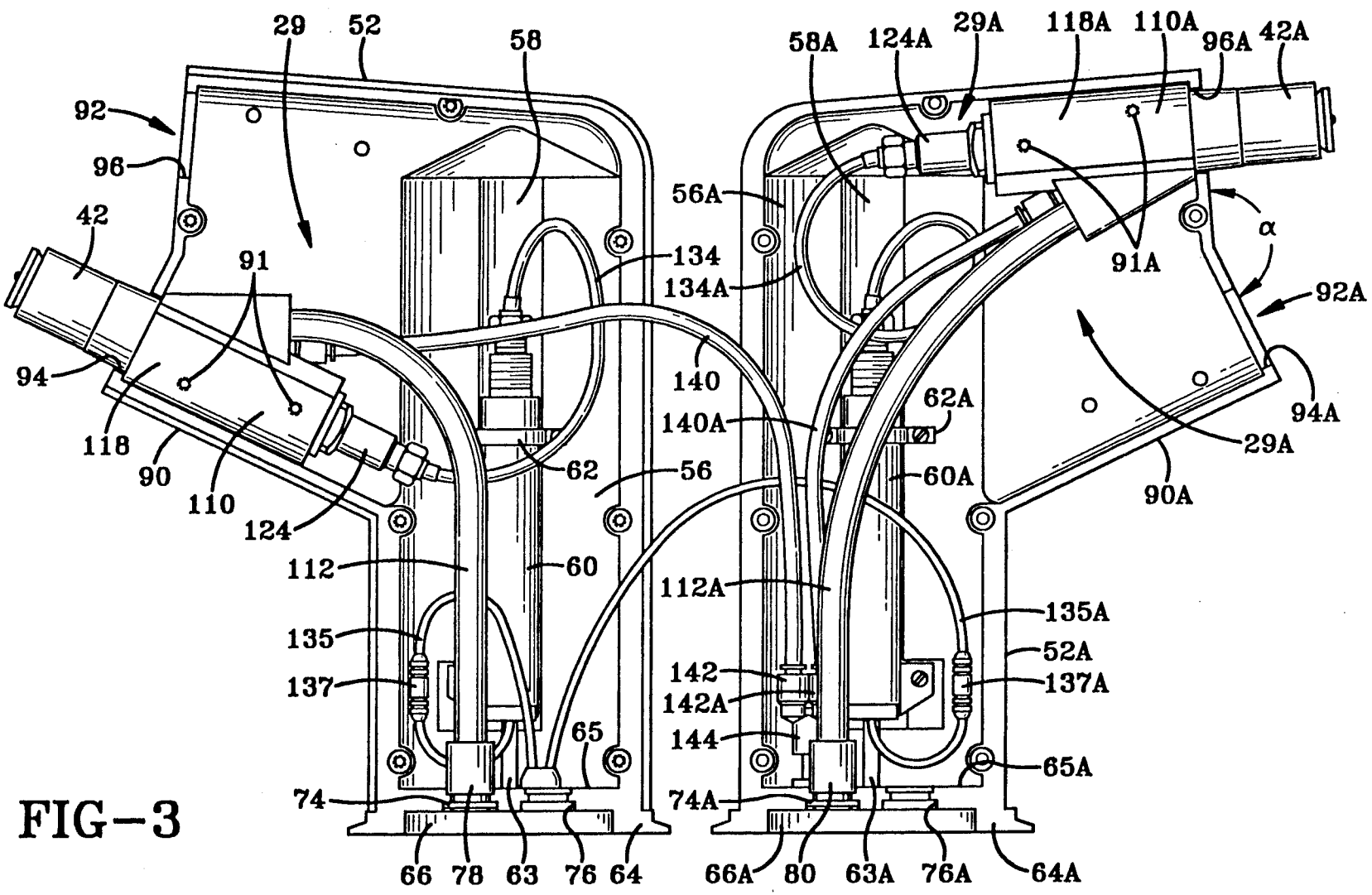
FIG. 3 is a side view showing opposite halves of a disassembled hollow housing with two powder coating guns and their flexible powder hoses, electrical lines, and air supply hoses therein.
Figure 4:
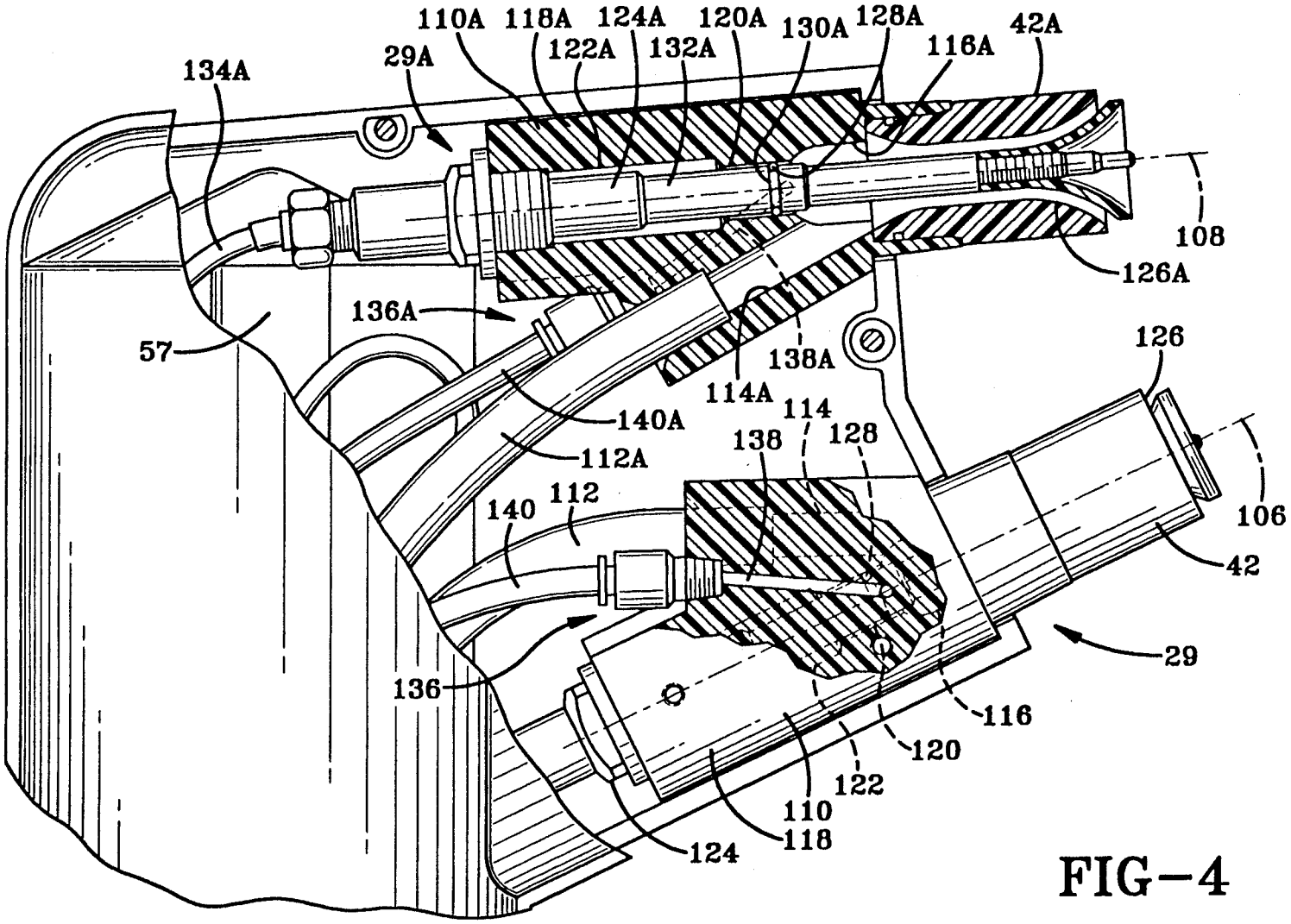
FIG. 4 is a partial cutaway, partially cross-sectioned, side view illustrating the electrode/resistor assemblies and powder purge system for cleaning the powder coating guns of coating powder.

The hollow housing 32, as illustrated in FIG. 3 has two mating sections 52 and 52A preferably constructed of electrically non-conductive, impact resilient material such as urethane plastic. The outer walls 54 and 54A of mating sections 52 and 52A, respectively, are constructed to provide recessed areas 56 and 56A which collectively form an internal chamber 57 when sections 52 and 52A are mated together, as illustrated in FIG. 4. Recessed areas 58 and 58A in the portion of the outer walls 54 and 54A which comprises the upstanding support section 34 forms a locator and support for voltage multipliers 60 and 60A associated with coating guns 29 and 29A, respectively. The voltage multipliers 60,60A face each other and are secured in place by clamps 62,62A which are screwed into the outer walls 54 and 54A, respectively. Further, the voltage multipliers 60,60A each have an ear at their lower end which is attached to the walls 54 and 54A by means such as screws. The bottom ends of voltage multipliers 60,60A abut against metal heat sink 63 and 63A which in turn abut against the upper surface 65 and 65A, respectively, of base ends 64 and 64A.

Figure 5:
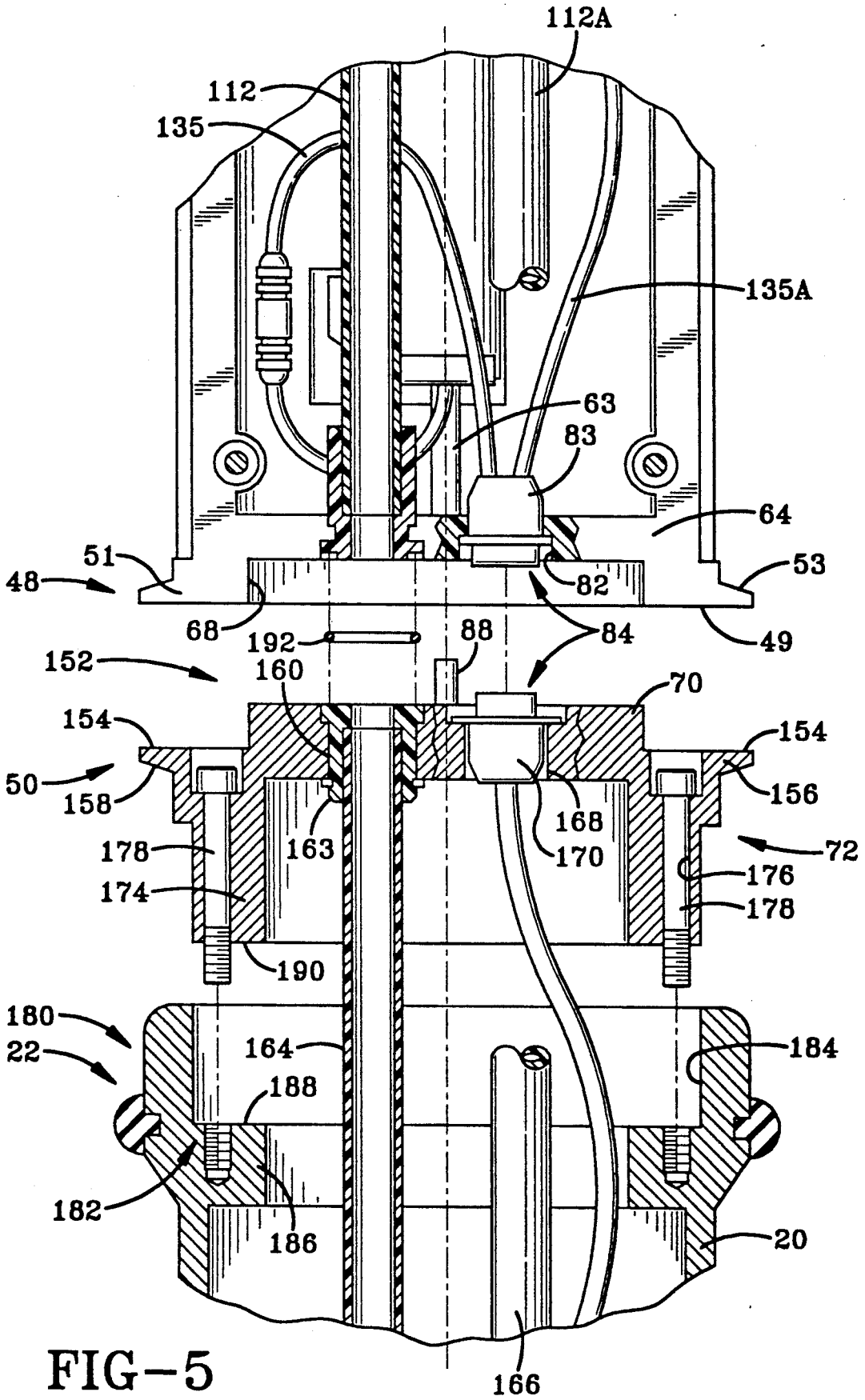
FIG. 5 is an exploded, partially cross-sectioned view illustrating the assembly of the housing containing the coating guns with a wrist adapter and a programmable robot.
Figure 6:
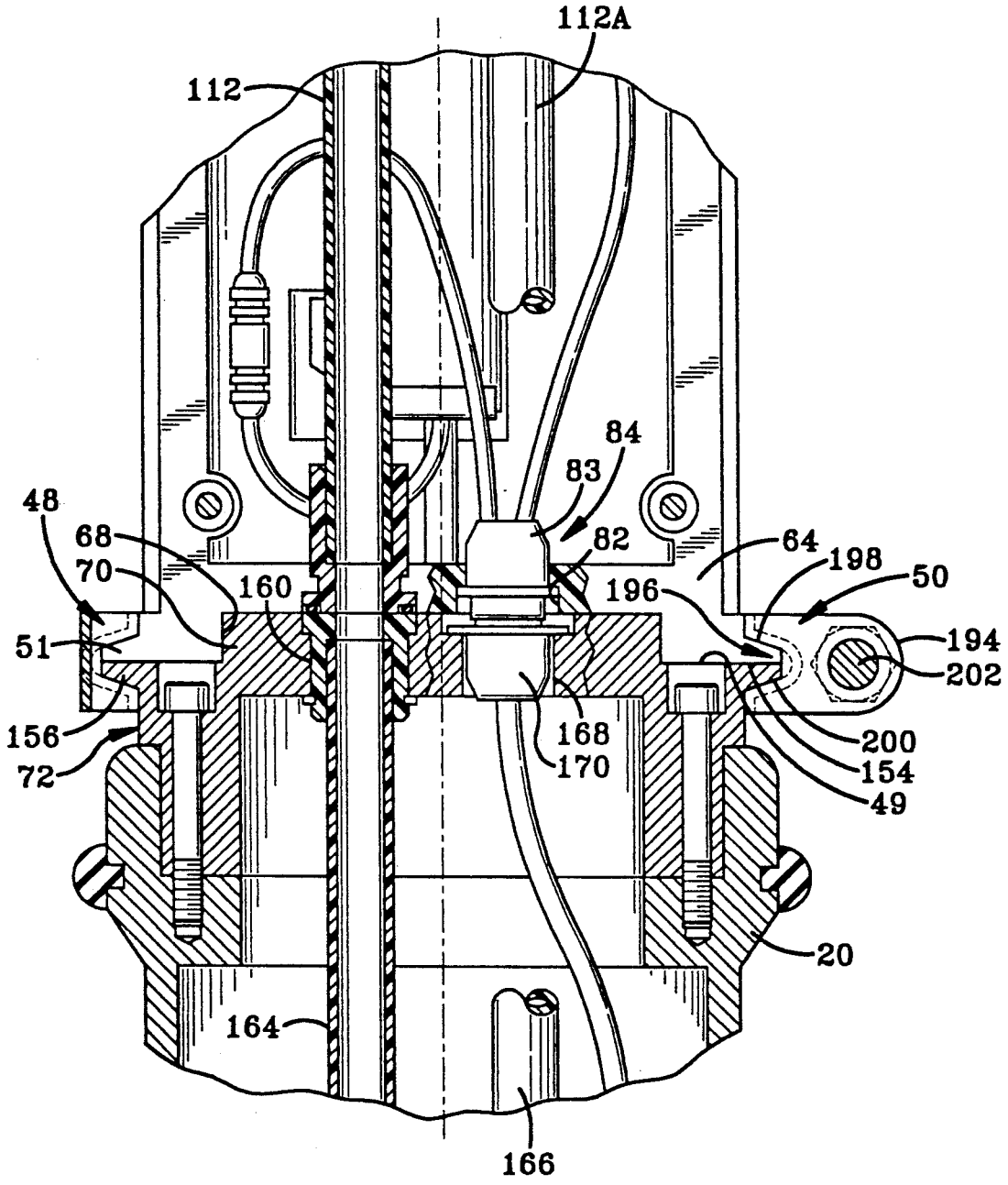
FIG. 6 is a partially cross-sectioned view illustrating the housing secured by a retaining clamp to the wrist adapter mounted in the programmable robot.
Figure 7:
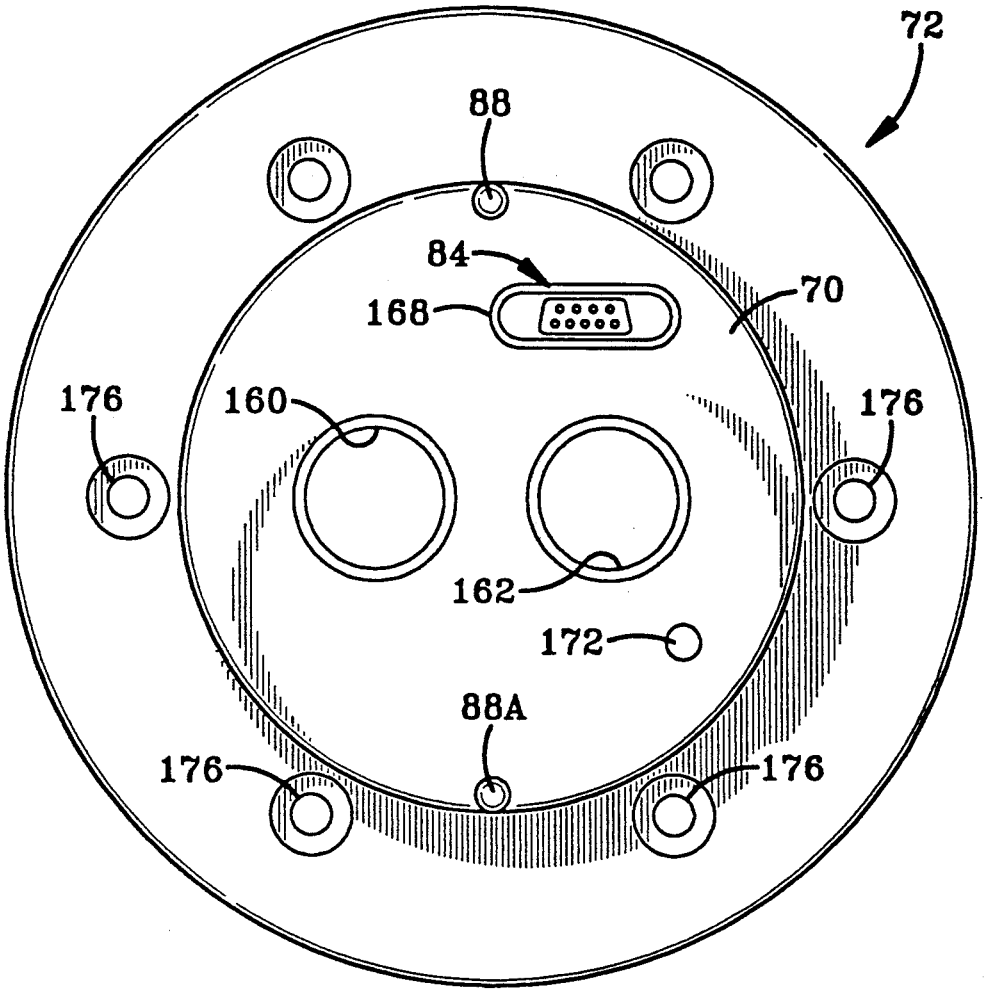
FIG. 7 is a plan view of the wrist adapter.

The base ends 64 and 64A of walls 54 and 54A, when mated, form the base end 48 of coating gun assembly 14, as illustrated in FIGS. 5 and 6. Base end 48 has a bottom flat surface 49 and a circular shaped flange 51 with an upper inclined surface 53. Each of the base ends 64 and 64A has a semicircular recess 66 and 66A which form a circular recess 68, when the sections 52 and 52A are mated together. Circular recess 68 receives inlet plate section 70 of a wrist adapter 72. Semicircular recesses 74, 76 and 74A,76A, extending between the semicircular recesses 66 and 66A and the internal chamber 57 provide stepped inlet openings which receive powder hose fitting adapters 78 and 80, as illustrated in FIG. 3. A stepped throughbore 82 through base end 64, as seen in FIGS. 5 and 6, receives one component 83 of an electrical receptacle 84. Two cylindrical bores (not shown) in base end 64 receive locating guide pins 88 and 88A which project upwardly from inlet plate section 70 of wrist adapter 72, as illustrated in FIG. 7.

Outer walls 54 and 54A include outer head wall portions 90 and 90A which form head section 40 of hollow housing 32 when the sections 52 and 52A are mated together. Head section 40 extends outward from one side of upper portion 36 of tubular, upright support section 34. The lowermost edges of head wall portions 90 and 90A extend outward from lower portion 38. Discharge end surfaces 92 and 92A have spaced semicircular recesses 94,96 and 94A,96A which form circular discharge openings 98 and 100, respectively, through which nozzles 42 and 42A project when sections 52 and 52A are mated together. Mated discharge end surfaces 92 and 92A include a lower surface section 102 with discharge opening 98 therethrough and an adjoining upper surface section 104 with discharge opening 100 therethrough. The guns 29 and 29A include resistor/electrode assemblies 110 and 110A which are secured within the head section 40 by means such as screws projecting through the side walls 90, 90A and into two threaded holes 91 and 91A on either side of the resistor/electrode assemblies 110 and 110A. The coating guns 29 and 29A are generally identical and designed like the type disclosed and illustrated in U.S. Pat. No. 5,056,720, assigned to the same assignee as this invention. Reference should be made to the disclosure of that patent for a detailed discussion of coating guns 29 and 29A which is incorporated by reference in its entirety herein.

For purposes of the present discussion, coating guns 29 and 29A, as illustrated in FIGS. 3 and 4, include flexible conduits or powder hoses 112 and 112A which deliver powder coating material from robot 12 which in turn is connected by hose conduit 113 to a source of powder coating material (not shown). The powder hoses 112 and 112A connect hose fitting adapters 78 and 80 to intake bores 114 and 114A that provide external access to throughbore 116,116A extending centrally through generally tubular sections 118,118A. Throughbores 116,116A communicate via transverse walls 120,120A with internal chambers 122,122A extending rearward through tubular sections 118,118A. Electrode assemblies 124,124A are threadedly mounted to the rear end of tubular sections 118,118A and extend through internal chambers 122,122A, transverse walls 120,120A and outward from discharge end 126,126A of nozzles 42,42A for electrostatically charging coating powder being discharged from the nozzles. O-rings 128 and 128A located in grooves 130 and 130A about a cylindrical section 132 and 132A of the electrode assemblies seal against transverse walls 120 and 120A, respectively, to prevent powder leakage from throughbores 116 and 116A to internal chambers 122 and 122A, respectively.

A principle feature of this invention is that the electrode assemblies 124,124A are connected by flexible electrostatic cables 134,134A of a desired length to the voltage multipliers 60,60A, respectively. The flexibility of cables 134 and 134A are an important aspect of the invention because they enable the electrode/resistors 110,110A to be easily assembled within housing 32 irrespective of the angle at which they are disposed with respect to each other. When the nozzles 42 and 42A are positioned at a different angle with respect to each other, i.e. for a different application, the electrode/resistors 110,110A of the coating guns 29 and 29A can be easily removed and assembled in another hollow housing providing a different gun position since the cables 124 and 124A can readily flex to accommodate the now position of electrode resistors 110 and 110A. The flexibility of electrostatic cables 134 and 134A is also an important aspect of the adjustability of the hollow housing and/or the electrode assemblies 124,124A in the other embodiments of the invention discussed below. The electrode assemblies 124,124A are further connected by flexible electrostatic cables 135,135A to one component 83 of electrical receptacle 84. Cables 135,135A can each have an electrical coupler 137,137A to facilitate assembly of the voltage multipliers 60 and 60A within the hollow housing.

Another aspect of the invention relates to air purge systems 136 and 136A to clean the throughbores 116 and 116A and the nozzles 42 and 42A of coating powder. Each electrode/resistor 110,110A has an air passageway 138 and 138A, located adjacent to intake bores 114,114A, which communicates with the throughbores 116,116A forward of the transverse walls 120,120A. Flexible conduits or air hoses 140 and 140A deliver pressurized air from robot 12, which in turn is connected by a conduit 141 to a source of pressurized air (not shown). Flexible air hoses 140 and 140A connect air passageway 138 and 138A with air hose fitting adapters 142 and 142A, respectively. The air hose fitting adapters 142,142A, in turn, are connected to a hose fitting adapter 144 which is secured within an air inlet bore (not shown) through the base end 64A of the hollow housing. The air inlet bore, in turn, is in flow communication with an air inlet bore (not shown) through wrist adapter 72.

In operation, the air purge systems 136 and 136A direct air into the throughbores 116,116A when the powder flow is turned off. The pressurized air is prevented from escaping through the passage in transverse walls 120,120A and then into the internal chambers 122,122A by the O-rings 128,128A between the transverse walls and the electrode assemblies 124,124A. The pressurized air exits from nozzles 42,42A and carries powder lodged in the throughbores 116,116A and nozzles 42,42A therewith. While the air purge systems are primarily for cleaning the coating guns 29 and 29A, it is also within the terms of the invention to direct air into the guns 29 and 29A along with the powder, in certain applications.

Referring to FIGS. 5, 6, and 7, there is shown the details of detachable mounting means 50 for detachably mounting the base end 48 of coating gun assembly 14 to the end of robot arm 20. The mounting means 50 includes a wrist adapter 72 which mates with base end 48. The wrist adapter 72 has an upper end 152 with a circular flat surface 154 and a circular shaped flange 156 with a downward facing inclined surface 158. The plate section 70, which projects upward from the surface 154, has two stepped throughbores 160 and 162 which have hose adapters 163 to connect with powder delivery hoses 164 and 166 which pass through the robot and connect to conduit 113. A stepped bore 168 through plate section 70 receives an electrical component 170 which couples with mating electrical component 83 of the electrical receptacle 84. A bore 172 is attached to a pressurized air line which extends through robot 12 and connects with the conduit 141 to a source of pressurized air. The locator pins 88 and 88A project upward from the surface of the plate section 70. The wrist adapter 72 has a cylindrical wall 174 which extends downward from the upper end 152. A plurality of countersunk, spaced bores 176 extend through the cylindrical wall 174 to receive mounting bolts 178.

The wrist adapter 72 is mounted to the wrist section 180 at the upper end of robot arm 20. The wrist section 180 has a wrist adapter receiving section 182 with a cylindrical recess 184 that intersects an inwardly extending support wall 186. Support wall 186 has a plurality of threaded bores extending from a support surface 188 and disposed to mate with spaced bores 176 of wrist adapter 72 when the wrist adapter is mounted in the wrist adapter receiving section 182. That is, the cylindrical wall 174 of wrist adapter 72 is inserted into the cylindrical recess 184 so that its lower end surface 190 abuts against the support surface 188 of support wall 186 and is secured in place with bolts 178.

The coating gun assembly 14 is easily mounted or dismounted to the wrist adapter 72 which is projecting outward from wrist 22 at the end of movable arm 20. Note that the pins 88 and 88A, projecting upward from the surface of the plate section 70, align the coating gun assembly 14 with respect to the wrist adapter 72. Then, the powder feed hoses 112, 112A abut against powder delivery hoses 164 and 166, respectively, with O-rings 192 therebetween to prevent leakage at their interface. In addition, the electrical connector 84 is coupled and the air line through the robot arm 20 (not illustrated) is secured via bore 172 through wrist adapter 72 to a corresponding inlet opening through the base end 64 to provide pressurized air to hose fitting adapter 144. A split circular barrel clamp 194 secures the coating gun assembly 14 and wrist adapter 72 when they are coupled together. The split circular barrel clamp 194 has an inner surface 196 with opposed clamping surfaces 198 and 200 diverging outwardly from each other. The clamp 194 is placed around the abutting circular shaped flange 51 and circular shaped flange 156 with its surface 198 engaged against surface 53 of circular shaped flange 51 and its surface 200 engaged against downward facing inclined surface 158 of circular shaped flange 156. When clamp 194 is tightened by a bolt 202, the opposed clamping surfaces 198 and 200 wedge against surfaces 53 and 158, as illustrated in FIG. 6, so that surface 49 is pressed against surface 154 to tightly couple the gun assembly 14 to wrist adapter 72. When an operator desires to dismount the gun assembly 14 from wrist adapter 72, bolt 202 is loosened and the clamp 194 spread apart and removed, as seen in FIG. 5.

Figure 8:
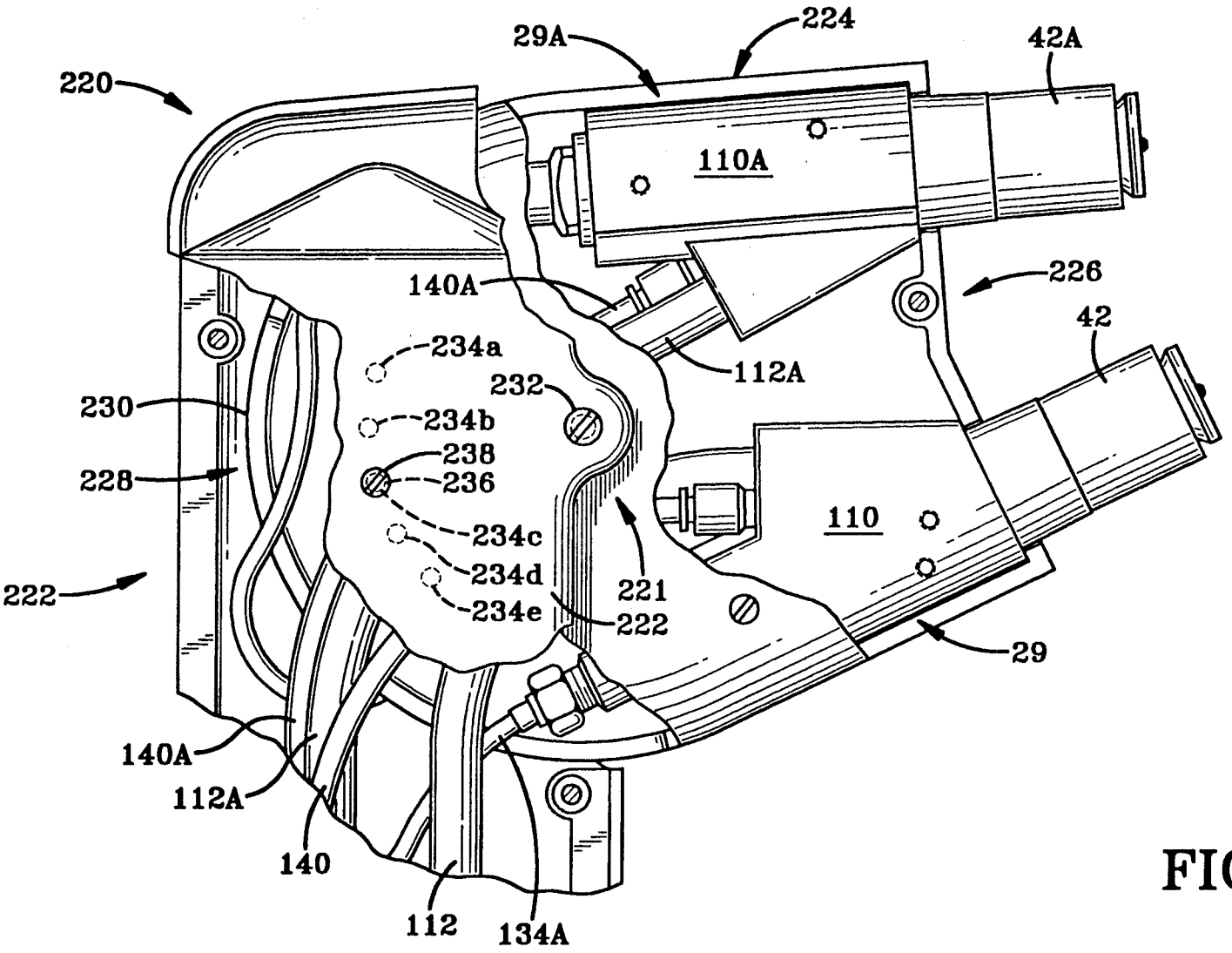
FIG. 8 is a cut away side view of a second embodiment of the invention showing the adjustable connection between the headsection and the upright body section of the hollow housing for changing the direction of the spray pattern.
Figure 9:
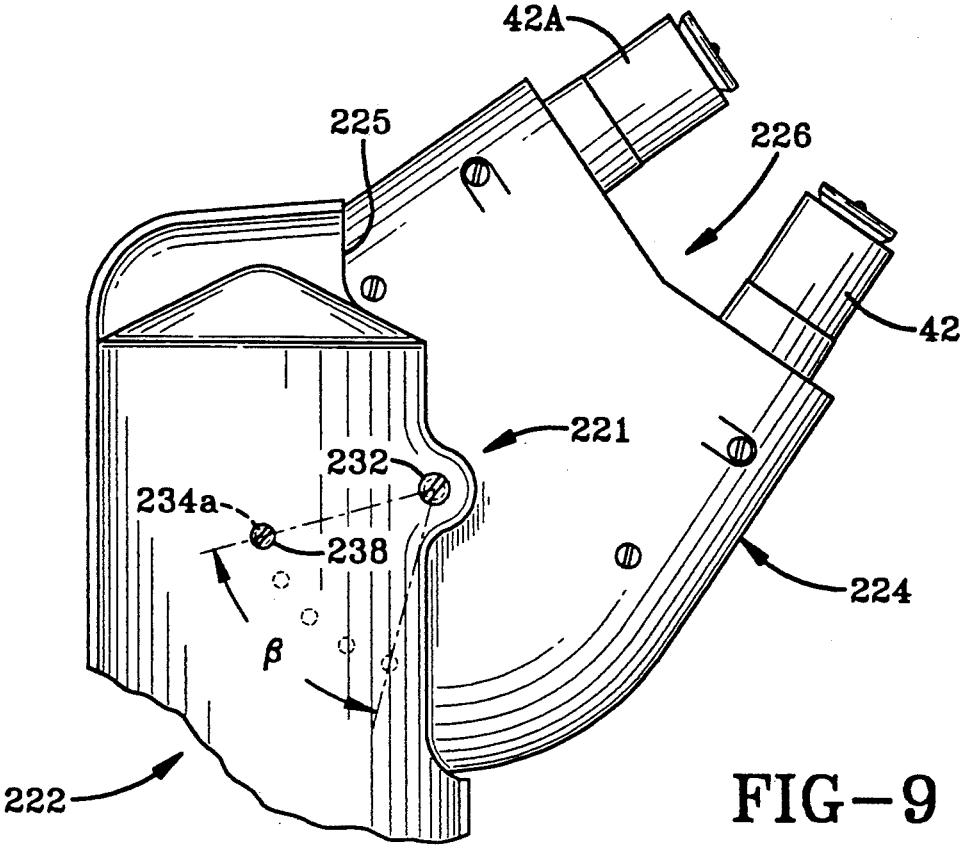
FIG. 9 is a side view of the second embodiment showing the head section in an upward position with respect to the upriqht body section of the hollow housing.
Figure 10:
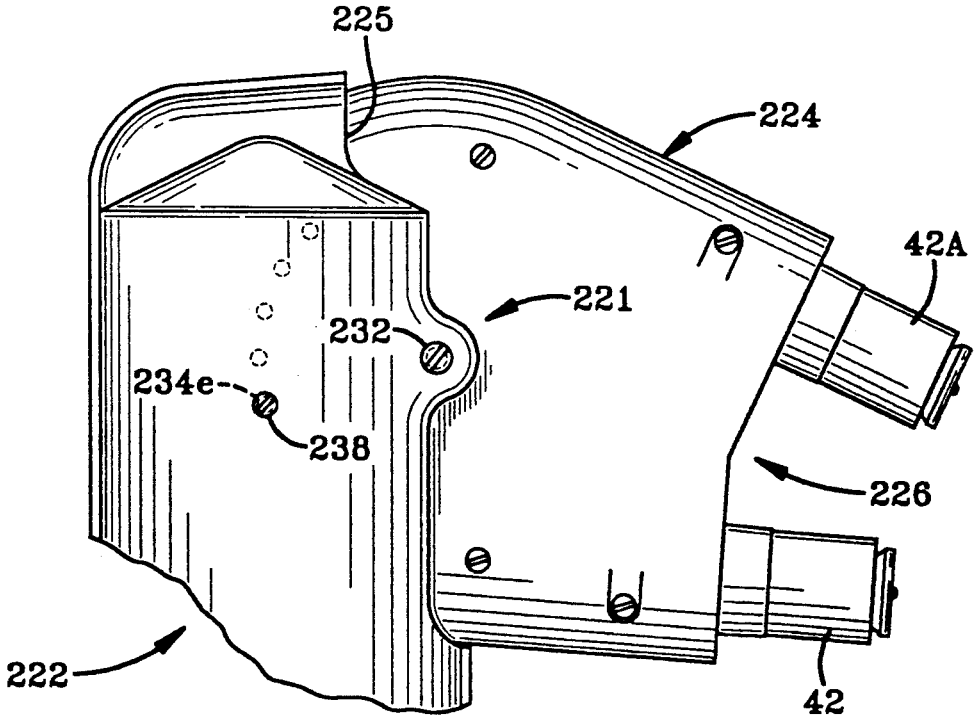
FIG. 10 is a side view of the second embodiment, which is similar to FIG. 9, except that the head section is in downward position with respect to the upright body section of the hollow housing.

While the above described embodiment of the invention provides a very effective means of assembling two coating guns 29 and 29A within a hollow housing 32 adapted for attachment to the arm 20 of a robot 10 and easy removal and replacement of the coating guns in a different housing to effect different relative positioning of the coating guns with respect to each other so that the spray pattern is changed, it is also within the terms of the invention to provide an alternative embodiment, as illustrated in FIGS. 8, 9, and 10, wherein the housing body 220 is adjustable so that the coating guns 29 and 29A, while remaining fixed relative to each other, can be moved relative to the mounting arm 20 by a simple adjustment of the housing body 220.

The second embodiment is generally identical with the first embodiment, as illustrated in FIGS. 2–4, except for means 221 for adjusting the position of the head section 224 with respect to the hollow, upright support section 222. Means 221 includes upper end of tubular, upright support section 222 being pivotally connected to the head section 224. The upright support section 222 has an opening 225 to receive the hollow head section 224. The head section 224 is constructed of two mating halves having a discharge end 226 through which the nozzles 42 and 42A of powder coating guns 29 and 29A project outward for spraying electrostatically charged, coating powder. Head section 224 also has a curved inlet end 228 with an opening 230 through which the flexible powder hoses, flexible electrical cables and flexible air lines pass to connect electrode/resistors 110 and 110A to the wrist adapter 72, as discussed before. The radius of curvature of inlet end 228 is substantially equal to the distance from a pivot point through which a rod like fastener or shaft, such as bolt 232, extends. Bolt 232 extends through the head section 224 and projects outwardly from the opposite sides of support section 222 to allow the head section 224 to rotate thereabout with respect to support section 222. The head section 224 has a plurality of positioning holes **234*a*,234*b*,234*c*,234*d*, and 234*e* disposed on opposite sides thereof. Each positioning hole located is located at an equal distance from the pivot point through which bolt 232 extends and has a corresponding positioning hole on the opposite half of the head section. The upright support section has two holes 236 on opposite sides thereof which receives a removable connecting pin, such as a bolt 238, that extends between the holes 236 on either side of the head section 224 and through a pair of aligned positioning holes 234*a*,234*b*,234*c*,234*d*, or 234*e*. To rotate the head section 224 with respect to the upright support section 222, the operator removes the bolt 238 and adjusts the head 224 to a desired position. Then the bolt 238 is reinserted into the holes 236 and the pair of aligned positioning holes so that the nozzles 42 and 42A emit the spray pattern in the desired direction. For example, as illustrated in FIG. 9, when the pin 238 is inserted in the position holes a, the head is rotated so that the nozzles 42 and 42A project upward. Conversely, when the pin 238 is inserted in the position holes 234*e*, as illustrated in FIG. 10, the head is rotated so that the nozzles 42 and 42A project downward. To accomplish the adjustment, the electrostatic cables, powder hoses and air hoses are all flexible so that the electrode/resistors 110 and 110A** can be moved with respect to the fixed voltage multipliers. The advantage of this embodiment of the invention is the speed and ease with which the adjustment of the direction of the spray pattern from the two coating guns can be accomplished. That is, the entire housing does not have to be removed from the robot arm, as in the prior art, so that the coating guns can be removed from the housing and inserted into a new housing constructed to position them at a desired angle with respect to the housing. This can provide a significant cost savings because the inventory of different housings is reduced or eliminated since one housing can be positioned to provide many different directions of spray.

Figure 11:
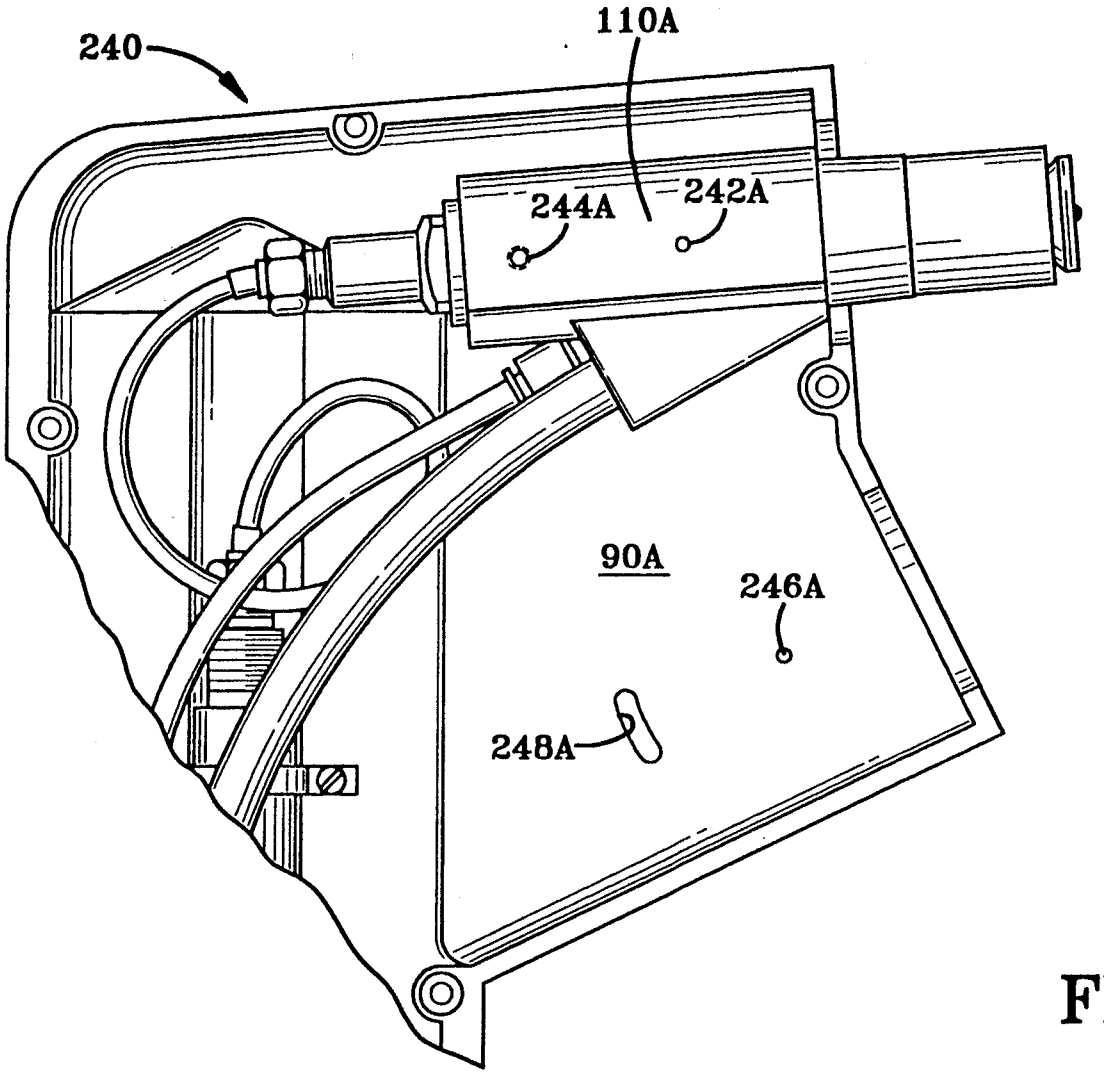
FIG. 11 is a cut away side view of a third embodiment of the invention showing one resistor/electrode assembly adjustably mounted within the head section of the hollow housing to enable the resistor/electrode assemblies to be moved with respect to each other so as to change the shape of the spray pattern.
Figure 12:
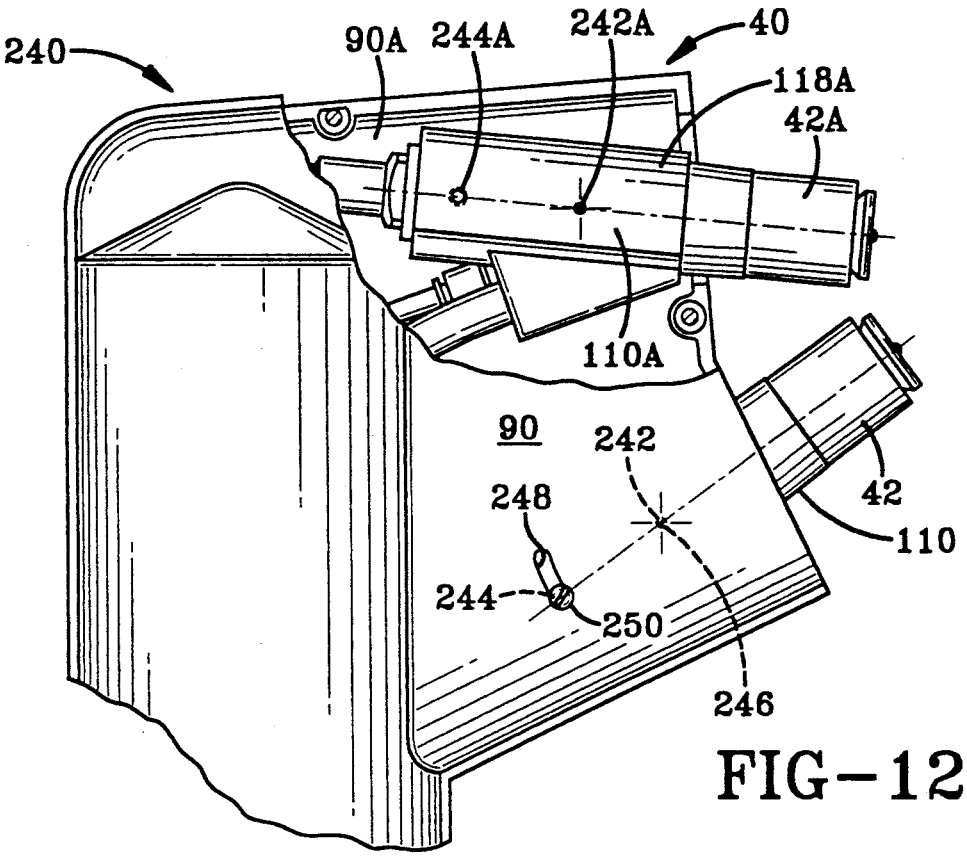
FIG. 12 is a side view of the third embodiment showing the resistor/electrode assemblies in a first position with respect to each other within the head section of the hollow housing.
Figure 13:
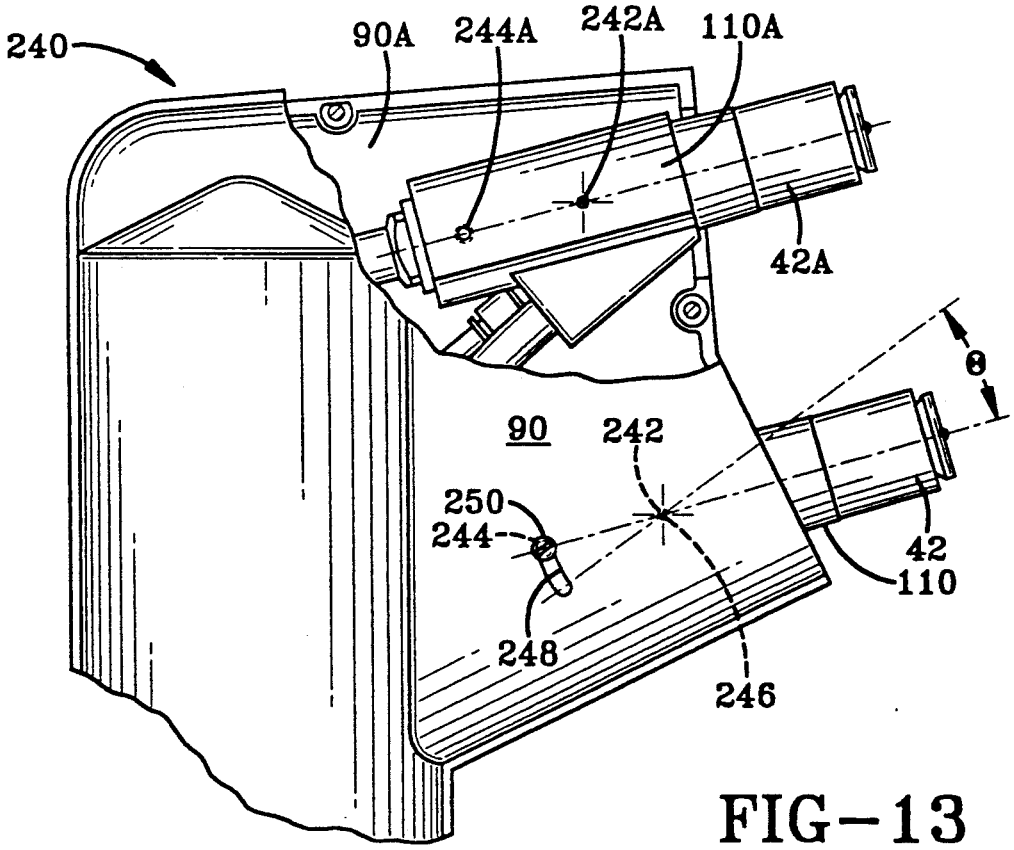
FIG. 13 is a side view of the third embodiment, similar to FIG. 12, except that the resistor/electrode assemblies are in a second position with respect to each other.

While the above described second embodiment of the invention provides a very effective means of assembling two coating guns 29 and 29A within an adjustable housing body 220 so that the coating guns, while remaining fixed relative to each other, can be moved relative to the mounting arm by a simple adjustment of the housing body 220, it is also within the terms of the invention to provide an alternative embodiment, as illustrated in FIGS. 11, 12, and 13, wherein the hollow housing body 240 is generally unadjustable like housing 32 except that the electrode/resistors 110 and 110A are adjustably mounted with respect to the head section 40 so that the spray pattern emitted from nozzles 42 and 42A can be changed.

As illustrated in FIGS. 11,12 and 13, each electrode/resistor 110 and 110A has forward and rearward positioned mounting holes 242,244,242A, and 244A, respectively, located on opposite sides of tubular sections 118 and 118A. Oppositely disposed upper and lower paired mounting pins 246 and 246A can be molded to the opposite, facing inner surfaces of the outer head wall portions 90 and 90A which form head section 40 of hollow housing 32 when the sections 52 and 52A are mated together, as discussed above. The mounting pins 246 and 246A project into the forward positioned mounting holes 242 and 242A on either side of tubular sections 118 and 118A, respectively, so that electrode/resistors 110 and 110A are pivotally mounted thereon. Oppositely disposed upper and lower, paired mounting slots 248 and 248A can be provided in the opposite facing head wall portions 90 and 90A which form head section 40 of hollow housing 32 when the sections 52 and 52A are mated together. The mounting slots 248 and 248A are constructed with a radius of curvature corresponding to the distance to the adjacent mounting pins 246 and 246A, respectively. A securing means, such as a screw 250, is inserted through the mounting slots 248 and 248A on either side of the head sections 90 and 90A and threaded into rearward positioned mounting holes 244 and 244A, respectively, to secure the electrode/resistors 110 and 110A in a desired position.

To adjust the position of the electrode/resistors 110 and 110A with respect to each other, the operator loosens screws 250 and rotates electrode/resistors 110 and 110A about the pairs of pivot pins 246 and 246A so that the ends of nozzles 42 and 42A move closer or further from each other, as illustrated in FIGS. 12 and 13, respectively to change the spray pattern. Then, the screws 250 are tightened. The advantage of this embodiment of the invention is the speed and ease with which the adjustment of the spray pattern can be achieved. As in the previous embodiments, the electrostatic cables, powder hoses and air hoses are all flexible so that the electrode/resistors 110 and 110A can be moved with respect to the fixed voltage multipliers. Further, the entire housing does not have to be removed from the robot arm so that the guns can be removed from the housing and inserted into a new housing which is constructed to position them at a desired angle with respect to each other. Further, the inventory of different housings is no longer need since one housing can be positioned to provide many different spray configurations.

While the above described third embodiment of the invention is illustrated and described in the context of a housing body where the head is molded into position with respect to the upright support section 222, it is also within the terms of the invention to provide adjustable electrode/resistors 110 and 110A in the adjustable housing, of the second embodiment illustrated in FIGS. 8–10.

While the invention has been described as using two coating guns, it is also within the scope of the invention to mount three or more coating guns within one hollow housing.

It is apparent that there has been provided in accordance with this invention a twin headed, electrostatic powder coating gun assembly in a lightweight, hollow housing that is readily adapted for mounting on a programmable robot so that the shape of the powder spray pattern can be controlled. To control the direction and/or shape of the powder spray pattern, the two powder coating guns can be mounted in an adjustable hollow housing which adjusts the coating guns without changing the relationship between them and/or mounted in a housing which enables the coating guns to be adjusted with respect to each other. The powder hoses, electrical cables and air lines between the robot and the coating guns are flexible to allow for the adjustment without changing any of these connections. The twin headed, electrostatic powder coating gun can include an air purge system to clean the nozzles of coating powder.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A powder coating gun assembly adapted for mounting to a robot, said coating gun assembly comprising:

a hollow housing having an upright support section and a head section extending outward from said upper portion upright support section;

a plurality of coating guns, each enclosed within said housing except for a nozzle projecting outward from a discharge end of said head section, for emitting a spray of powder from a discharge end of said housing, said coating guns each being secured to said hollow housing whereby each said nozzle is at a fixed, preset position with respect to said nozzle of another of said plurality of guns; and means for detachably mounting said hollow housing to said robot.

2. The powder coating gun assembly of claim 1 wherein said hollow housing is molded from electrically, non-conductive urethane plastic.

3. The powder coating gun assembly of claim 1 wherein said hollow housing is assembled from two mating sections which form an internal chamber to house said coating guns when said mating sections are secured together.

4. The powder coating gun assembly of claim 3 wherein said means for detachably mounting said hollow housing to said robot includes a base end of said upright support section which can be removably mounted to a wrist adapter which is secured to said robot.

5. The powder coating gun assembly of claim 4 wherein said coating guns housed within said internal chamber each include:

a voltage multiplier secured to said upright support section;

a resistor/electrode assembly secured to said head section;

a flexible powder hose which delivers powder coating material from said robot to said resistor/electrode assembly; and a flexible electrostatic cable which connects said voltage multiplier, respectively, to said resistor/electrode assembly.

6. The powder coating gun assembly of claim 5 wherein:

said base end of said hollow housing includes:

hose fitting adapters extending therethrough which connect to each flexible powder hose; and a first electrical component extending therethrough having at least two flexible electrostatic cables extending therefrom, each of said cables being connected to one of said voltage multipliers, respectively; and said wrist adapter which is adapted to couple to said base end of said hollow housing includes:

hose adapters extending therethrough adapted to connect by flexible hoses to a source of coating powder material, said hose adapters being sealed to said hose fitting adapters when said hollow housing is mounted to said wrist adapter; and a second electrical component extending therethrough adapted to connect by an electrostatic cable extending therefrom which is adapted to be connected to a power supply, said second electrical component being coupled to said first electrical component when said hollow housing is mounted to said wrist adapter.

7. A powder coating gun assembly adapted for mounting to a robot, said coating gun assembly comprising:

a hollow housing molded from electrically, non-conductive urethane plastic having an upright support section and a head section extending outward from said upright support section, said hollow housing being assembled from two mating sections which form an internal chamber to house said coating guns when said mating sections are secured together;

a plurality of coating guns, each enclosed within said housing except for a nozzle projecting outward from a discharge end of said head section, for emitting a spray of powder from a discharge end of said housing; and means for detachably mounting said hollow housing to said robot including a base end of said upright support section which can be removably mounted to a wrist adapter which is secured to said robot, said means for detachably mounting said hollow housing to said robot further including:

said base end having a circular flange thereabout with an upward facing inclined surface;

a circular flange about said wrist adapter with a downward facing inclined surface; and a circular barrel clamp having opposed clamping surfaces which wedge against said upward facing inclined surface and said downward facing inclined surface, respectively, to tightly couple said base end against said wrist adapter.

8. A powder coating gun assembly adapted for mounting to a robot said coating gun assembly comprising:

a hollow housing having an upright support section and a head section extending outward from said upright support section;

a plurality of coating guns mounted within said housing for emitting a spray of powder coating material from a discharge end of said head section, each of said coating guns including:

a voltage multiplier secured to said upright support section of said hollow housing;

a resistor/electrode assembly secured to said head section of said hollow housing;

a flexible powder hose which delivers powder coating material from said robot to said resistor-/electrode assembly; and a flexible electrostatic cable which connects said voltage multiplier to said resistor/electrode assembly.

9. The powder coating gun assembly of claim 8 wherein said hollow housing is assembled from two mating sections which form an internal chamber to house said coating guns when said mating sections are secured together.

10. The powder coating gun assembly of claim 9 including means for detachably mounting said hollow housing to said robot, said means for detachably mounting includes a base end of said upright support section which can be removably mounted to a wrist adapter secured to said robot.

11. The powder coating gun assembly of claim 10 wherein said means for detachably mounting said hollow housing to said robot includes:

said base end having a circular flange thereabout with an upward facing inclined surface;

a circular flange about said wrist adapter with a downward facing inclined surface; and a circular barrel clamp having opposed clamping surfaces which wedge against upward and downward facing inclined surfaces to tightly couple said base end against said wrist adapter.

12. The powder coating gun assembly of claim 8 further including air purge systems to clean each resistor/electrode assembly of said powder coating material after the flow of said powder coating material is turned off, said air purge systems including flexible air hoses within said hollow housing which deliver depressurized air to each resistor/electrode assembly.

13. The powder coating gun assembly of claim 12 wherein each said resistor/electrode assembly includes:

a throughbore therethrough which communicates via a transverse wall with an internal chamber extending rearward through said resistor/electrode;

an electrode assembly which extends through said internal chamber, said transverse wall, and outward from a nozzle of one of said coating guns for electrostatically charging coating powder being discharged from said nozzle; and a seal between said electrode assembly and said transverse wall to prevent powder leakage from said throughbore to said internal chamber.

14. The powder coating gun assembly of claim 13 wherein said air purge systems each include an air passageway through said resistor/electrode assembly which communicates with said throughbore forward of said transverse wall to direct pressurized air therein and purge said powder from said throughbore and said nozzle.

15. The powder coating gun assembly of claim 14 wherein a hose fitting adapter extends through said base end of said hollow housing and each said resistor/electrode assembly to said hose fitting adapter by said flexible air hose.

16. A powder coating gun assembly adapted for mounting to a robot said gun assembly comprising:

a hollow housing body having an upright support section and a head section adjustably attached thereto;

a plurality of coating guns mounted in said hollow housing body for emitting a spray pattern of coating powder from a discharge end of said head section; and means for adjusting the position of said head section with respect to said hollow body whereby the direction of said spray pattern of powder emitted by said coating guns from said discharge end can be controlled.

17. The powder coating gun assembly of claim 16 wherein:

said upright support section has an opening in its upper end which receives a curved inlet end of said head section having an opening therethrough; and said means for adjusting the position of said head section with respect to said hollow housing body includes:

a bolt which extends through said head section and projects outward from opposite sides of said support section to enable the head section to turn thereabout with respect to said support section;

a plurality of positioning holes located on either side of said head section along an arc at an equal distance from said bolt and corresponding positioning holes through opposite sides of said upright support section;

two holes aligned with each other and extending through opposite sides of said upright support section; and a removable connector that extends between through holes and through a pair of aligned positioning holes to adjust said head section to a desired position to emit the spray pattern in the desired direction.

18. The powder coating gun assembly of claim 17 wherein said coating guns housed within said hollow housing body each include:

a voltage multiplier secured to said upright support section;

a resistor/electrode assembly secured to said head section;

flexible conduits passing through said opening to deliver powder coating material from said robot to said resistor/electrode assemblies; and flexible electrostatic cables passing through said opening to connect voltage multipliers respectively, to resistor/electrode assemblies.

19. The powder coating gun assembly of claim 17 further including means for adjusting the position of said plurality of coating guns with respect to each other to change the spray pattern of coating powder emitted from said discharge end of said head section.

20. The powder coating gun assembly of claim 19 wherein:

said plurality of coating guns each includes:

a voltage multiplier secured to said upright support section;

a resistor/electrode assembly secured to said head section;

a flexible conduit which delivers powder coating material from said robot to said resistor/electrode assembly; and a flexible electrostatic cable which connects the voltage multiplier to said resistor/electrode assembly; and said means for adjusting said position of said plurality of coating guns includes:

forward and rearward positioned mounting holes located on opposite sides of said resistor/electrode assemblies;

oppositely disposed upper and lower paired mounting pins extending outward from opposite, facing inner surfaces of said head section to project into the forward positioned mounting holes so that said resistor/electrode assemblies are pivotally mounted thereon;

oppositely disposed upper and lower, paired mounting slots through opposite facing surfaces of said head section and having a radius of curvature having a radius equal to the distance to the corresponding mounting pins; and adjustment securing means inserted through said mounting slots and secured within said rearward positioned mounting holes.

21. A powder coating gun assembly adapted for mounting to a robot, said gun assembly comprising:

a housing body having an upright support section and a head section adjustably attached thereto;

a plurality of coating guns mounted in said housing body for emitting a spray pattern of coating powder from a discharge end of said head section; and means for adjusting the position of said plurality of coating guns with respect to each other to change the spray pattern of coating powder emitted from said discharge end of said head section.

22. The powder coating gun assembly of claim 21 wherein:

said plurality of coating guns each includes:

a voltage multiplier secured to said upright support section;

a resistor/electrode assembly secured to said head section;

flexible conduits which deliver powder coating material from said robot to said resistor/electrode assemblies; and flexible electrostatic cables which connect voltage multipliers, respectively, to resistor/electrode assemblies; and said means for adjusting said position of said plurality of coating guns includes:

forward and rearward positioned mounted holes located on opposite sides of said resistor/electrode assemblies;

oppositely disposed upper and lower paired mounting pins extending outward from opposite, facing inner surfaces of said head section to project into the forward positioned mounting holes so that resistor/electrode are pivotally mounted thereon;

oppositely disposed upper and lower, paired mounting slots through opposite facing surfaces of said head section and having a radius of curvature having a radius equal to the distance to the corresponding mounting pins; and adjustment securing means inserted through said mounting slots and secured within said rearward positioned mounting holes.

23. The powder coating gun assembly of claim 21 wherein said plurality of coating guns each includes means for adjusting the position of said head section with respect to said housing body wherein the direction of said spray pattern of powder emitted from said discharge end can be controlled.

24. The powder coating gun assembly of claim 23 wherein:

said upright support section has an opening in its upper end which receives a curved inlet end of said head section having an opening therethrough; and said means for adjusting the position of said head section with respect to said housing body includes:

a bolt which extends through said head section and projects outward from opposite sides of said support section to enable said head section to turn thereabout with respect to said upright support section;

a plurality of positioning holes located on either side of said head section along an arc at an equal distance from said bolt and corresponding positioning holes through opposite sides of said upright support section;

two securing holes aligned with each other and extending through opposite sides of said upright support section; and a removable connector that extends between said securing holes and through a pair of aligned positioning holes to adjust said head section to a desired position so that said spray pattern is emitted from said discharge end in the desired direction.

25. The powder coating gun assembly of claim 24 wherein said coating guns housed within said housing body each include:

a voltage multiplier secured to said upright support section;

a resistor/electrode assembly secured to said head section;

a flexible conduit passing through said opening of said upright support section to deliver powder coating material from said robot to said resistor/electrode assembly; and a flexible electrostatic cable passing through said opening of said upright support section to connect said voltage multiplier to said resistor/electrode assembly.

* * * * *